US006941882B2

(12) United States Patent
Sawada et al.

(10) Patent No.: US 6,941,882 B2
(45) Date of Patent: Sep. 13, 2005

(54) APPARATUS FOR SEWING SLIDE FASTENER CHAIN ONTO CLOTH PIECE

(75) Inventors: Toshiaki Sawada, Toyama (JP); Makoto Yamazaki, Kurobe (JP)

(73) Assignee: YKK Corporation, Tokyo (JP)

( * ) Notice: Subject to any disclaimer, the term of this patent is extended or adjusted under 35 U.S.C. 154(b) by 27 days.

(21) Appl. No.: 10/731,497

(22) Filed: Dec. 8, 2003

(65) Prior Publication Data

US 2004/0129190 A1 Jul. 8, 2004

(30) Foreign Application Priority Data

Dec. 12, 2002 (JP) ..... P.2002-360309

(51) Int. Cl.[7] ..... D05B 3/22; D05B 35/06

(52) U.S. Cl. ..... 112/470.33

(58) Field of Search ..... 112/475.33, 475.16, 112/122, 129, 152, 304, 307, 217.1, 470.36, 470.33; 83/56, 356.2, 907; 29/408, 410; 24/396

(56) References Cited

U.S. PATENT DOCUMENTS 4,152,996 A 5/1979 Van Amburg
4,593,635 A * 6/1986 Boser et al. ..... 112/475.16
4,608,745 A * 9/1986 Miyakawa et al. ..... 29/408
4,674,422 A 6/1987 Boser
4,714,038 A * 12/1987 Boser ..... 112/475.17
5,161,474 A 11/1992 Ishikawa et al.

FOREIGN PATENT DOCUMENTS

| | | |
|---|---|---|
| EP | 0 329 480 A1 | 8/1989 |
| JP | 63-12856 | 4/1988 |
| JP | 63-79691 | 4/1988 |

* cited by examiner

*Primary Examiner*—Ismael Izaguirre
(74) *Attorney, Agent, or Firm*—Michael S. Leonard; Everest Intellectual Property Law Group

(57) ABSTRACT

In a slide fastener chain sewing apparatus, a continuously supplied slide fastener chain is successively sewn onto a pair of left and right cloth pieces. A chain cutter cuts the slide fastener chain between the cloth pieces which are moved continuously over a sewn product transfer device table and suspending from a front end of the table. A sewn product receiving section has sewn product transfer means for receiving, in a lower part, a sewn product cut away from the succeeding cloth piece having the fastener chain sewn thereto. The sewn product transfer device transfers the sewn product to a rear end of the table through a lower space portion of the table.

11 Claims, 10 Drawing Sheets

APPARATUS FOR SEWING SLIDE FASTENER CHAIN ONTO CLOTH PIECE

BACKGROUND OF THE INVENTION

1. Field of the Invention

The present invention relates to an automatic sewing apparatus which is suitable for sewing a slide fastener chain onto a pair of long and wide cloth pieces such as pajamas for children, a curtain, clothes for women, a sheet or a cushion cover, and particularly to an automatic sewing apparatus for a fastener chain in which a size thereof is reduced and the labor of an operator is saved by the effective utilization of a space which cannot be used practically.

2. Description of the Related Art

Conventionally, there has been developed this kind of apparatus for automatically sewing a slide fastener chain onto a pair of long and wide cloths. For example, according to Japanese Utility Modes Publication S63-12856B (JP-UM-B-63-12856), a towing device for reciprocating a gripper holding a sewn and discharged tip portion according to a sewing speed horizontally in a discharge direction is provided on the discharge side of a sewing machine constituting the main body of the sewing machine and the gripper is supported to be able to tilt at a predetermined angle in a horizontal state. By the tilt of the gripper, even if the length of the protrusion of the towing device is smaller than the length of a sewn product, a towing distance is increased. Thus, a long sewn product can be towed to a predetermined position. In addition, the sewn product can be prevented from being accumulated in disorder on the discharge side of the sewing machine. Consequently, the efficiency of a sewing work can be enhanced.

In order to sew a long cloth piece, moreover, a comparative complicated manual work is required for positioning a cloth piece in the sewing machine or a manual work for sewing requires such a skill as to accurately align the cloth piece with respect to a unit type slide fastener to be sewn thereonto. For this reason, a large number of defective clothes are often made. In order to solve such a problem, according to Japanese Patent Publication S63-79691A (JP-A-63-79691), for example, a slide fastener chain fed from a continuous feeding reel can be mechanically brought into a sewing step portion. When two cloth pieces are caused to come in contact with mechanical guide means to operate an apparatus, the cloth pieces are mechanically aligned accurately with the slide fastener chain, and at the same time, the edge portions of the cloth pieces are bent to come to a portion provided under the slide fastener chain. When automatic positioning is completed, a sewing machine sews both side portions of the slide fastener chain onto a pair of cloth pieces. While the slide fastener chain is being sewn, the cloth is held under tension.

According to this publication, the slide fastener chain is automatically cut to have a constant length in response to the fact that the rear end of a cloth is sensed. Accordingly, the length of the slide fastener provided to the clothes is determined by the length of a sewn product. A cloth sewn onto the slide fastener chain is pulled by pulling means to a point placed apart from the apparatus, and a discharging device in a horizontal direction delivers a sewn product to a storage table. The storage table is automatically brought down with the accumulation of the sewn product. When the cloth is moved in the horizontal direction to reach the mounting rack of the storage table, the pulling means is returned to an adjacent position to the sewing machine and this operation is repeated.

JP-UM-B-63-12856 gazette and JP-A-63-79691 gazette are known as related art.

In the conventional sewing operation of this type, a sewing operator stands on this side of an apparatus and sets a pair of cloth pieces to be newly sewn into a predetermined position on a base (table), and feeds them to a sewing section through a feed roller. By the sewing apparatus disclosed in each of the publications, the same operation is carried out. Moreover, the same operator usually collects a predetermined number of sewn cloth pieces in the forward part of the sewing section of the sewing apparatus and delivers them to a storage section. If the operator does not carry out the delivery, another operator delivers the cloth pieces. For this reason, it is necessary for the operator to move to the forward part of the apparatus—every delivery. Consequently, a physical fatigue is caused. When a special operator for the delivery is prepared, personnel expenses are required correspondingly so that the price of a product is influenced.

SUMMARY OF THE INVENTION

The object of the invention is to provide an apparatus for sewing a slide fastener chain onto a cloth piece in which the physical fatigue of a sewing operator can be relieved also when the same operator takes charge of delivery without preparing a special operator for the delivery of a sewn cloth piece, and the size of the apparatus can be reduced.

The invention provides an apparatus for sewing a slide fastener chain onto a cloth piece in which a slide fastener chain supplied continuously is successively sewn onto a pair of cloth pieces having an optional size, comprising a table on which a sewing machine is provided and which guides the cloth pieces during sewing, a cutting section having chain cutting means for cutting a fastener chain between the cloth pieces having the fastener chain sewn by the sewing machine, moved continuously over the table, and suspending from a front end of the table, and a sewn product receiving section having sewn product transfer means for receiving, in a lower part, a sewn product cut away by the cutting means from the succeeding cloth piece having the fastener chain sewn thereonto and transferring the sewn product to a rear end of the table through a lower space portion of the table.

The sewing operator adapts and sets the tips of a pair of left and right cloth pieces into the next sewing portion of the fastener chain fed continuously in a predetermined position on the table at this side of the sewing machine in the same manner as in the conventional art. When the apparatus is operated, the fastener chain is fed over the table to the sewing machine with interposition between a pair of cloth pieces, and the left and right tape edge sections of the fastener chain are sewn onto the opposed side edge portions of the cloth pieces. At this time, the tip edges of the cloth pieces are pulled synchronously with a sewing speed by pulling means disclosed in the publications, for example.

Furthermore, the table includes a sewing section having an upward inclined surface, a cloth piece transfer section having a downward inclined surface which is provided continuously with the sewing section, and a suspending and guiding section for suspending and guiding the cloth piece from a front edge of the cloth piece transfer section. Thus, the table is formed to be angular and the suspending and guiding section for the cloth piece is provided on the front edge thereof. Consequently, the same cloth piece can be guided and supported with a longitudinally short table length and the longitudinal occupied space of the apparatus can be reduced so that a space can be effectively used practically. Moreover, the suspending and guiding section of the cloth piece is provided on the front end. Therefore, means for feeding a cloth piece can be provided in the suspending and guiding section to positively feed the cloth piece downward synchronously with the sewing speed.

When the tip of the sewn cloth piece gets over the front end of the cloth piece transfer section of the table, the moving direction of the cloth piece is turned downward and the cloth piece is fed downward in a suspending state along the suspending and guiding section. When the sewn cloth piece is to be fed downward in the suspending state along the suspending and guiding section, it is desirable that the same cloth piece should be pushed against the guide surface of the suspending and guiding section and should be positively fed downward as described above. For this reason, in the invention, it is desirable that a cloth piece delivery section for energizing toward the suspending and guiding section and controllably rotating synchronously with a sewing speed of the sewing section are provided.

A sewn product receiving section is provided on the suspending line of the cloth piece, and the transfer means of the sewn product receiving section receives the suspending sewn product and properly holds a part of the same sewn product by holding means. When the rear end of the sewn product reaches a cutting section during the holding, the cutting means of the chain cutting section is operated to cut the fastener chain sewn onto the left and right cloth pieces together with a next cloth piece. The sewn product from which the fastener chain is cut drops by a deadweight and separates from the table. Thus, the sewn cloth pieces which drop successively are received and held by the sewn product transfer means standing by in the lower part of the table.

Every time the sewn product receiving section receives the sewn product, operating means operates the sewn product transfer means to be moved to the rear end of the table, and then returns the sewn product transfer means to the receiving portion. Therefore, it is suitable that the sewn product transfer means should include a rotating belt provided under the table in a longitudinal direction, a first holding and releasing member fixed to a part of the belt and extended in a transverse direction of the table, a first cylinder fixed to the first holding and releasing member, and a second holding and releasing member which is supported on the first cylinder and is provided adjacently and opposite to a cloth piece holding surface on a rear side of the table in the first holding and releasing member.

The first holding and releasing member holds the suspending sewn product. Therefore, it is desirable that the cloth piece holding surface of the first holding and releasing member should be shifted backward from a suspending position in order to avoid an interference with the suspending sewn product in a standby position. At the same time, it is desirable that the second cylinder should be fixed to the second holding and releasing member and there should further be provided a second cloth piece holding surface which is supported on the second cylinder and is disposed adjacently and opposite to the cloth piece holding surface on the rear side of the table in the first holding and releasing member.

More specifically, when the suspending end of the sewn product suspends to the forward part of the holding surface of the first holding and releasing member, the suspending is detected by detecting means such as a photoelectric sensor, thereby operating the first cylinder and the second cylinder and holding the suspending end of the sewn product by means of the first holding and releasing member and the second holding and releasing member. The rotating belt is rotated to move the first holding and releasing member and the second holding and releasing member together toward the rear end side of the table from the suspending position of the suspending end. By this movement, a portion to be fed after holding the sewn product is caught in such a state as to be loosened toward the rear end side of the table in the first holding and releasing member. When the same product is cut away from a succeeding sewn product, the rotating belt is rotated to move the first holding and releasing member and the second holding and releasing member to the rear end of the table with the sewn product held.

The second cylinder is operated to release the holding, thereby discharging the sewn product to a predetermined position. When the discharge is carried out, the rotating belt is reversely rotated to return the first holding and releasing member and the second holding and releasing member to original standby positions, thereby waiting for the suspending of a next sewn product therein. Every time the sewn product is cut away from the guide section of the table, thus, the same sewn product is transferred to the predetermined position of the rear end of the table. When a predetermined number of sewn products are collected at hand, the sewing operator delivers them in a lump to a predetermined delivery portion.

In the invention, moreover, it is also possible to further have a support base provided under the table and extended in a transverse direction of the table from an adjacent portion to a forward part, a third cylinder supported on the support base, and a third holding and releasing member supported on the third cylinder and provided adjacently and opposite to a cloth piece holding surface on a forward side of the table in the first holding and releasing member. In this case, it is desirable that a counter for counting the number of operations of the cutting means should be provided in the cut section and the sewn product receiving section should be operated to move the sewn product transfer means to the rear end of the table, to discharge a predetermined number of sewn products and to return the sewn product transfer means to a receiving portion when the counting of the count reaches a predetermined number.

In the case in which the sewn product receiving section is provided with the first to third holding and releasing members and the first to third cylinders for operating them, thus, it is not necessary to move each of the sewn products transmitted sequentially in a suspending state to the predetermined position of the rear end of the table and to move the guide surface of the table to the predetermined position of the rear end of the table until the sewn product receiving section holds a predetermined number of sewn products as described above. At this time, a predetermined number of sewn products can be held by counting the number of the operations of the cutting means and operating the first to third cylinders in a predetermined procedure.

More specifically, when the suspending end of the sewn product suspends to the forward part of the holding surface of the first holding and releasing member, this is detected by detecting means such as a photoelectric sensor or the feeding length of the cloth piece is measured by length measuring means provided in the cloth piece guide section. When the length reaches a predetermined length, the first cylinder and the second cylinder are operated to hold the suspending end of the sewn product by means of the first holding and releasing member and the second holding and releasing member.

The rotating belt is rotated to move the first holding and releasing member and the second holding and releasing member together toward the rear end side of the table from the suspending position of the suspending end. By this movement, a portion to be fed after holding the sewn product is caught on the rear end side of the table in the first holding and releasing member in a loosened state. When the sewn product is cut away from a succeeding sewn product, the rear end of the sewn product drops by a deadweight and is caught in the first holding and releasing member with the suspending end interposed between the first holding and releasing member and the second holding and releasing member. Subsequently, the rotating belt is reversely rotated to return the first holding and releasing member and the second holding and releasing member to original standby positions. Then, the third cylinder is operated to move the holding surface of the third holding and releasing member toward a part on the opposite side of the sewn product caught in the first holding and releasing member and suspending downward, thereby holding the same portion by means of the first and third holding and releasing members. When the holding is completed, the second cylinder is operated to separate the second holding and releasing member from the first holding and releasing member, thereby releasing the holding of the suspending end of the sewn product.

At this time, the third holding and releasing member maintains the exact position. When the next sewn product is held by the second holding and releasing member, however, the third cylinder is operated and moved backward and is thus separated from the first holding and releasing member. Thus, the same operation is repeated so that succeeding sewn products are received and held by the first holding and releasing member so as to be superposed on the first sewn product. At this time, the number of the operations of the cutting means is counted in the cutting section. When the number reaches a preset number of the sewn products to be held by the sewn product receiving section and a final sewn product is held by the first and second holding and releasing members, the rotation of the rotating belt is started and the preset number of sewn products are transferred in a lump to the rear end of the table. The sewn products transferred in a lump are released and the sewing operator takes them out and delivers them to a predetermined storage place.

In the invention, furthermore, it is desirable that front edge detecting means for detecting the front edge of the cloth piece and length measuring means for measuring the cloth piece should be provided in the transfer path of the cloth piece. It is desirable that the means for detecting the front edge of the cloth piece should be provided in the suspending and guiding section. As described above, when the front edge is detected by the detecting means, the length measuring means is operated through a control section which is not shown, thereby measuring the passage length of the cloth piece. When the length reaches a predetermined length, the second cylinder is operated through the control section which is not shown, and the lower end of the sewn product is held between the first holding and releasing member and the second holding and releasing member.

When the preceding cloth piece is to be cut, moreover, the cloth piece delivery section of the suspending and guiding section is stopped. Also during the stop, the succeeding cloth pieces are continuously sewn in some cases. In these cases, the succeeding cloth pieces sewn completely are excessively supplied forward and are accumulated in the forward part of the table. When the rear edge of the succeeding cloth piece is detected by rear edge detecting means for detecting rear edge of the cloth piece, a detection signal is sent to the control section to temporarily increase the delivery speed of the delivery section, thereby pulling out the cloth pieces accumulated on the table. The cutting means and the sewing means are interlocked. The amount of sewing from the stop of the delivery of the cloth piece to the detection of the rear edge of the succeeding cloth piece is measured. Based on the amount of the sewing, a time taken for the high-speed operation of the delivery section is controlled.

Moreover, the front edge detecting means and the rear edge detecting means can be practically used also in the case in which cloth pieces having various lengths are mixed. When the front edge of the cloth piece is detected by the front edge detecting means, a time is counted by means of a timer until the rear edge of the cloth piece is detected by the rear edge detecting means. The length of the cloth piece is determined by the count and the cutting position of the succeeding fastener tape is determined. Accordingly, it is possible to optionally correspond to the cloth pieces having various lengths by the front and rear edge detecting means.

In the case in which the cloth piece has a constant length, furthermore, the front edge detecting means or the rear edge detecting means can also be singly used as detecting means for operating the cutting means. More specifically, the length of the cloth piece to be an object for sewing a fastener chain is previously stored in a control section which is not shown. When the timer or the length measuring means is operated to obtain a predetermined time or length simultaneously with the detection of the detecting means, an operation signal is sent to the cutting means of the fastener chain to operate the cutting means.

Thus, the front and rear edge detecting means and the length measuring means can be used as detecting means for the operation/stop of various operating members.

DETAILED DESCRIPTION OF THE PREFERRED EMBODIMENTS

An embodiment of the invention will be specifically described with reference to the drawings based on a typical example.

Figure 1:
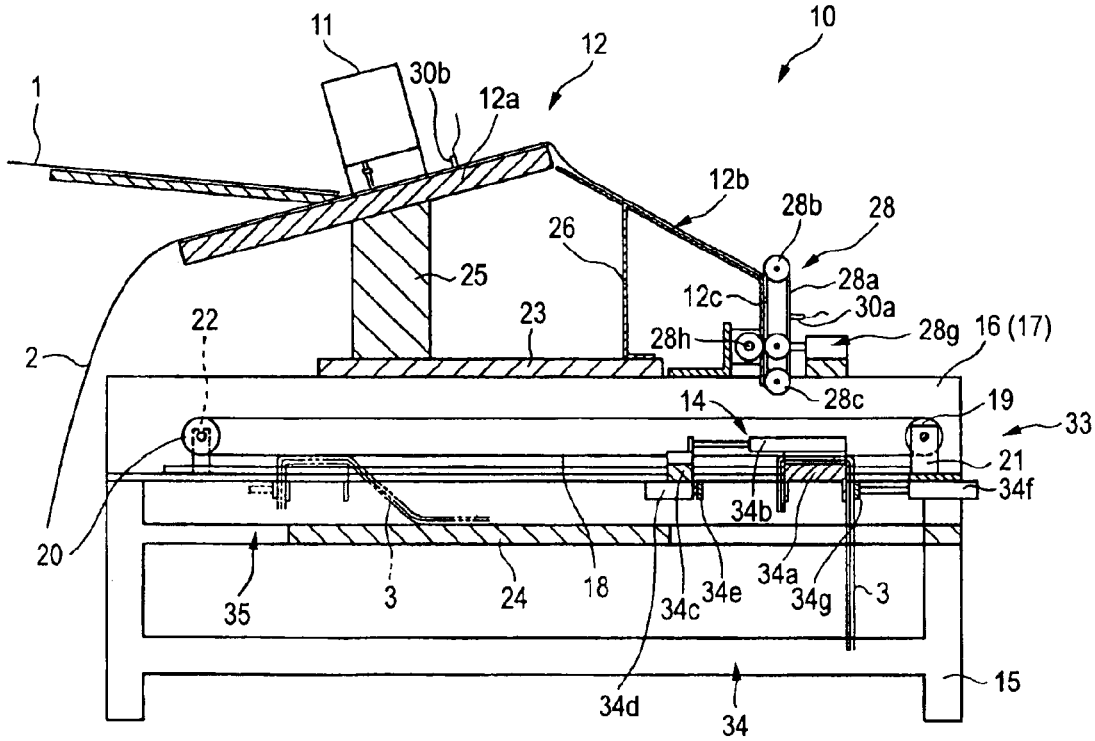
FIG. 1 is a side view schematically showing the whole structure of an apparatus for sewing a slide fastener chain onto a cloth piece according to a typical embodiment of the invention.

FIG. 1 shows a first embodiment of an apparatus for sewing a slide fastener chain onto a cloth piece according to the invention.

A sewing apparatus 10 according to the invention serves to sew, through a sewing machine 11, a slide fastener chain 2 fed continuously along the opposed side edges of a pair of left and right cloth pieces 1 transferred intermittently, to then feed the sewn slide fastener chain 2 forward over a table 12, to cut, by means of a cutting section 31, a portion between the front and rear cloth pieces 1 onto which the fastener chain 2 is continuously sewn during the transfer, and to cut away respective sewn products 3.

In the invention, a basic structure is characterized in that the sewn product 3 cut away by the cutting section 31 is received by a sewn product receiving section 14 provided below the cutting section 31 and the sewn product 3 thus received is automatically transferred to a rear end to be the cloth piece supply side of the table 12 by utilizing the lower space of the table 12.

According to the embodiment, a pair of left and right machine frames 15 are provided in a sewing direction with greater left and right widths than the whole maximum widths of the left and right cloth pieces 1 required for the sewing, and bases 16 and 17 for supporting the table are fixed onto the left and right machine frames 15, respectively. The bases 16 and 17 have L-shaped sections, and rotating rollers 19 and 20 for rotating a rotating belt 18 are rotatably supported on support brackets 21 and 22 in horizontal portions thereof. The rotating roller 19 provided in a forward part is a driving roller to be controllably driven by a normal and reverse rotating motor which is not shown, and the rotating roller 20 provided in a rear part is a driven roller. A rack 23 for the table is provided transversely on the upper surfaces of the left and right bases 16 and 17, and furthermore, a guide plate 24 for supporting and guiding the sewn product 3 is provided in an almost middle portion in the vertical direction of the left and right machine frames 15.

The table 12 is provided on the rack 23 for the table through table support members 25 and 26. A transverse width of the table 12 crossing the direction of transfer of a cloth piece is enough for corresponding to the maximum width of a product to be sewn. The table 12 is constituted by a sewing section 12*a* inclined upward in the direction of the transfer of the cloth piece 1 as seen from a side, a transfer section 12*b* inclined downward in connection to the sewing section 12*a*, and a suspending and guiding section 12*c* for suspending and guiding the cloth piece 1 provided from the front edge of the transfer section 12*b* vertically downward. When the table 12 is thus formed angularly as seen from the side, a whole length in a transfer direction can be more reduced as compared with an ordinary plate-shaped table even if a length for supporting and guiding the cloth piece 1 having the same size is equal. Thus, the installation length of the whole apparatus can be more reduced. In the embodiment, moreover, the cloth piece supply table 12*b* for supplying two cloth pieces 1 toward the sewing machine 11 provided in the sewing section 12*a* with side edges opposed to each other is inclined downward, and the continuous fastener chain 2 is supplied toward a portion between the joined portion of the two cloth pieces 1 through a guide which is not shown.

Figure 2:
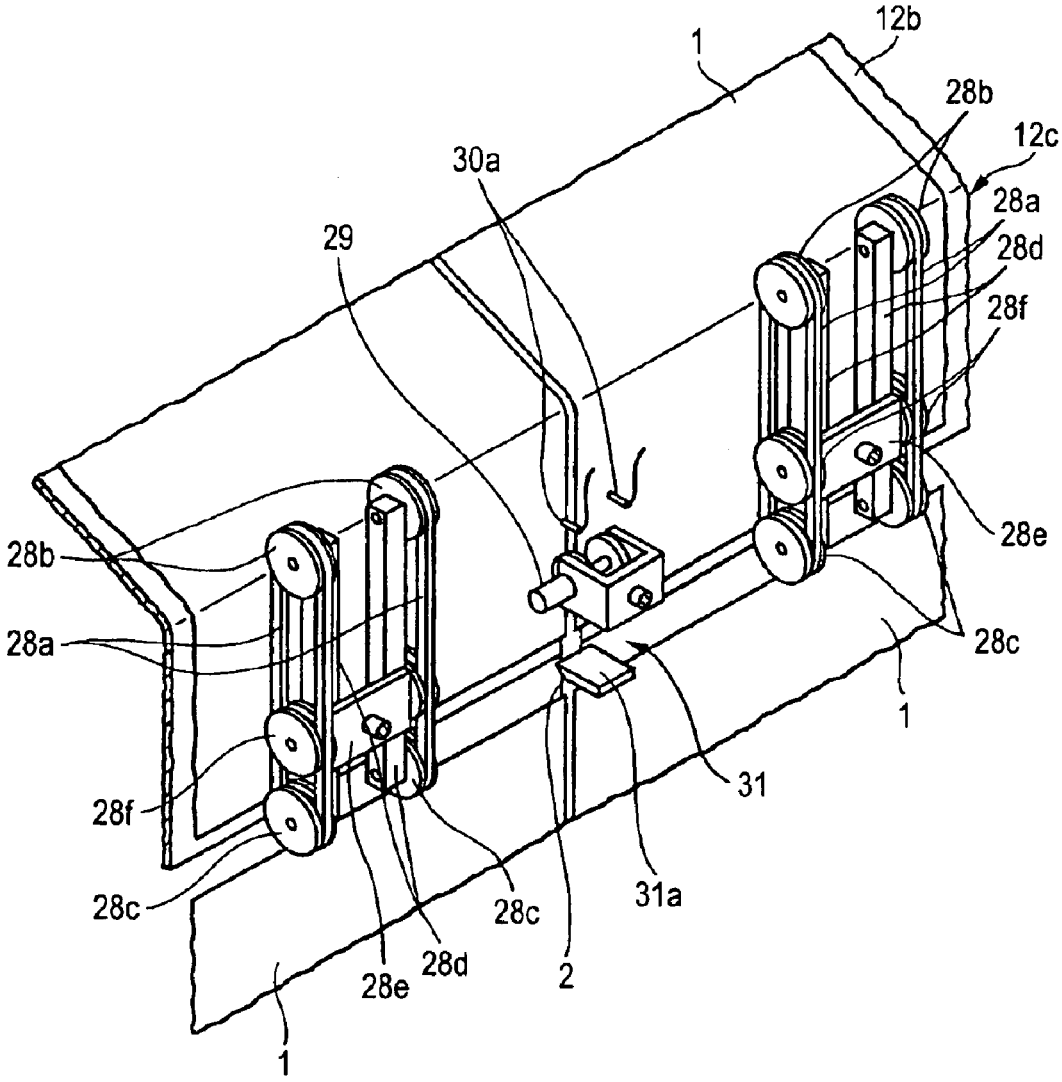
FIG. 2 is a partial perspective view showing the delivery section of the tip portion of a table according to the embodiment.

The sewing machine 11 is provided in the sewing section 12*a* and a cloth piece delivery section 28 interposes the completely sewn cloth piece 1 of the fastener chain 2 together with a non-end belt 28*a* and positively feeds the same cloth piece 1 downward so as to come in pressure contact with the guide surface of the suspending and guiding section 12*c*. The cloth piece delivery section 28 is constituted by the left and right non-end belts 28*a* making a pair which are laid around a pair of left and right rollers 28*b* and 28*c* for rotating a belt as shown in FIG. 2. The rollers 28*b* and 28*c* for rotating a belt are rotatably supported by one roller support member 28*d* respectively, and the roller support members 28*d* are coupled to be H-shaped through a plate-shaped coupling member 28*e*. A plurality of cloth piece delivery sections 28 is provided in the transverse direction of the suspending and guiding section 12*c* and serves to hold the cloth piece 1 in a plurality of positions in the transverse direction thereof and to prevent the outer edge portion of the suspending cloth piece 1 from suspending prior to a central portion.

Figure 3:
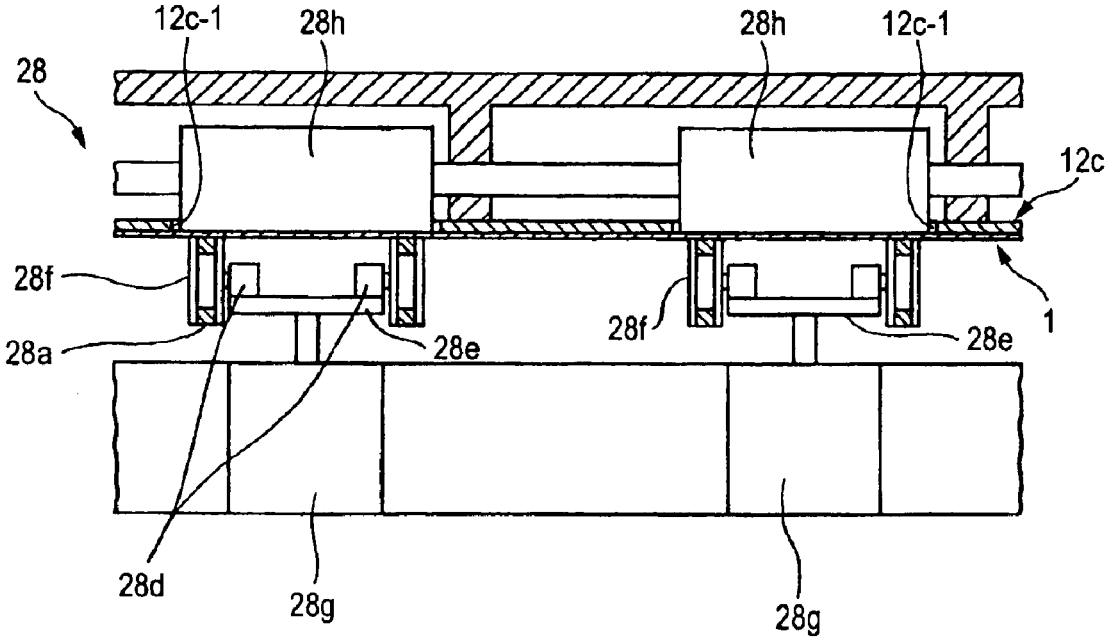
FIG. 3 is a sectional view showing the main part of the delivery section.

Moreover, a press roller 28*f* is rotatably supported in the middle portion of the roller support member 28*d*. The coupling member 28*e* has a surface opposite to the suspending and guiding section 12*c* which is fixed to the rod end of a cylinder 28*g* (see FIG. 3). By the operation of the cylinder 28*g*, the rollers 28*b*, 28*c* and 28*f* can be moved forward and backward with respect to the cloth piece 1 fed into a portion between the rollers and the suspending and guiding section 12*c* and can carry out pressing and releasing operations through the non-end belt 28*a* with respect to the cloth piece 1. A driving roller 28*h* is provided opposite to the press roller 28*f* (see FIG. 3). When the cylinder 28*g* is operated and the press roller 28*f* presses the driving roller 28*h* through the cloth piece 1, the rotating belt 28*a* is rotated to positively feed the cloth piece 1 downward. For this reason, a window section 12*c*-1 is formed in the suspending and guiding section 12*c* in such a manner that a partial peripheral surface of the driving roller 28*h* is exposed from the back side to the surface side.

Furthermore, there is provided a length measuring device 29 comprising an encoder capable of approaching and separating from the fastener chain 2 sewn onto the left and right cloth pieces 1 delivered through the suspending and guiding section 12*c*. In addition, a first cloth piece end detector 30*a* for detecting each of the front ends of a pair of left and right cloth pieces 1 having the fed fastener chain 2 sewn thereonto is provided adjacently to a portion placed just above the length measuring device 29 (see FIGS. 1 and 2). As shown in FIG. 1, moreover, a second cloth piece end detector 30*b* for detecting each of the rear ends of the left and right cloth pieces 1 having the fastener chain 2 sewn thereonto is provided in the sewing section 12*a* of the table 12. As shown in FIG. 2, furthermore, a cutting section 31 of the fastener chain 2 is provided adjacently to the lower part of the lower edge of the suspending and guiding section 12*c*. A photoelectric type end detector is usually used for the cloth piece end detectors 30*a* and 30*b*.

The cutting section 31 has a cutting blade 31*a* for moving forward and backward with respect to the fastener chain 2 exposed from a portion between the front and rear cloth pieces 1 which have the fastener chain 2 sewn thereonto and are delivered sequentially at a predetermined interval along the suspending and guiding section 12*c*, and furthermore, has a cylinder (not shown) to move the cutting blade 31*a* forward and backward. Moreover, a fixed blade 31*b* is provided in an opposed position to the cutting blade 31*a* with the fed cloth piece 1 interposed therebetween. The operation of the cylinder (not shown) is carried out based on a command transmitted from a control section (not shown) upon receipt of a signal sent from the length measuring device 29. When the lower end of the cloth piece is detected by the first cloth piece end detector 30*a*, the length measuring device 29 starts to measure a length through the control section upon receipt of a detection signal. When a predetermined length measurement is carried out, a signal is sent to the cylinder of the cutting section 31 which is not shown so that the cutting blade 31*a* is operated to cut the fastener chain 2.

On the other hand, as shown in FIG. 1, the sewn product receiving section 14 to be a part of a feature of the invention is provided below the cutting section 31. The sewn product receiving section 14 has sewn product transfer means 33. The sewn product transfer means 33 includes the rotating belt 18 provided under the table 12, the rotating rollers 19 and 20 for rotating and guiding the rotating belt 18, and a driving motor (not shown) for normally and reversely driving the rotating roller 19. Moreover, the sewn product transfer means 33 also includes holding and releasing means 34 for utilizing the rotation of the rotating belt 18 to receive the sewn product 3 from which the fastener chain 2 is cut and for utilizing the rotation of the rotating belt 18 to hold and transfer the sewn product 3 from a front part of the machine frame 15 toward a rear part thereof, thereby releasing and discharging the sewn product 3 in the discharge position of the rear part.

Figure 4:
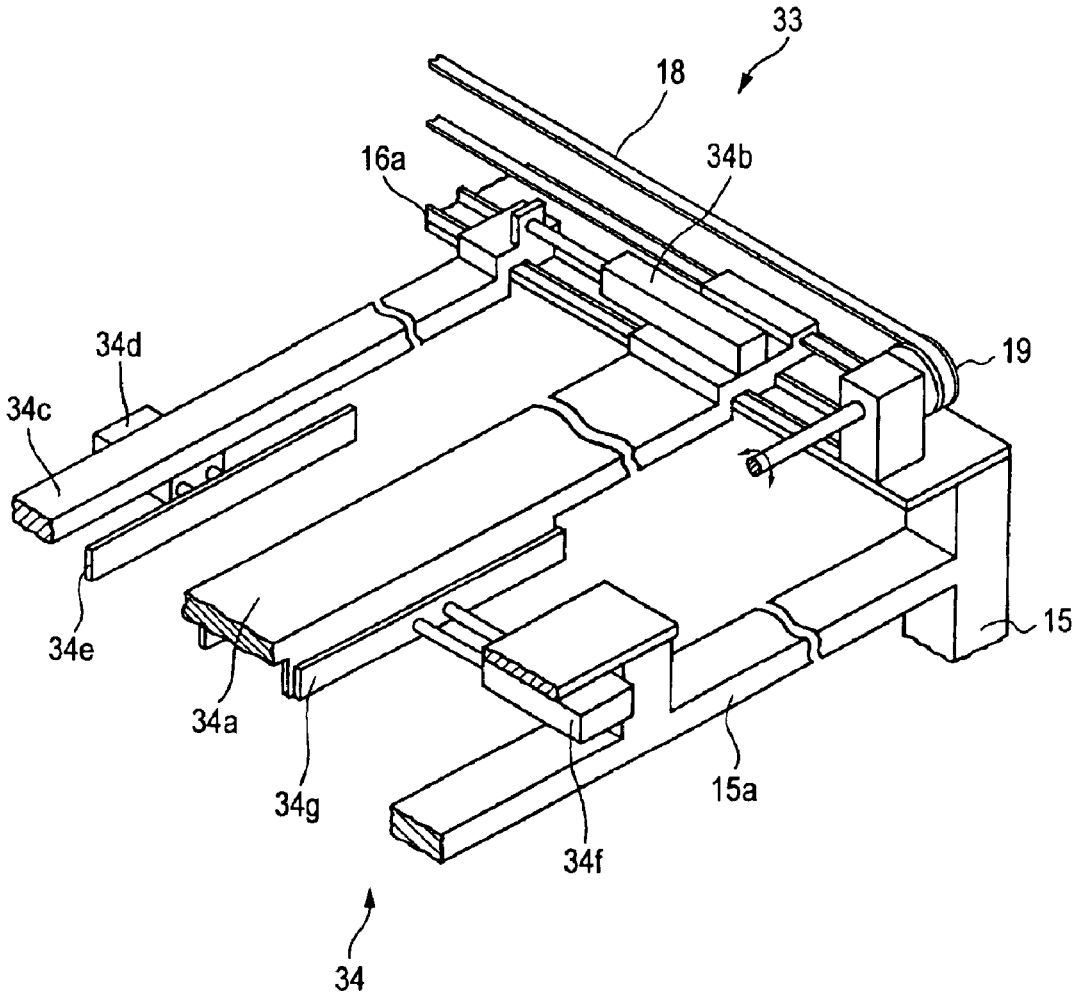
FIG. 4 is a partial perspective view showing the main part of a sewn product receiving section.

As shown in FIGS. 1 and 4, the holding and releasing means 34 according to the embodiment includes a first holding and releasing member 34*a* formed by an elongated and thick plate member which has one of ends fixed to a part of the rotating belt 18 and is extended over almost the whole width of the table 12, a first cylinder 34*b* which is fixed to one of the ends of the first holding and releasing member 34*a* and expands and contracts toward the rear side of the table 12, a second holding and releasing member 34*c* formed by a plate member having a small width and a great thickness which is supported on the rod end of the first cylinder 34*b* and approaches and separates from the cloth piece holding surface of the first holding and releasing member 34*a*, a second cylinder 34*d* fixed to the lower surface of the second holding and releasing member 34*c*, and a guide rail 16*a* provided in the horizontal portion of the base 16 and serving to guide the running operation of the first holding and releasing member 34*a*.

In the embodiment, a holding plate member 34*e* to approach and separate from a cloth piece holding surface on the rear side of the table 12 in the first holding and releasing member 34*a* is fixed to the rod end of the second cylinder 34*d*, and the surface of the holding plate member 34*e* which is opposed to the first holding and releasing member 34*a* constitutes a second cloth piece holding surface. Moreover, the machine frame 15 has a fixed support base 15*a* extended to cross the direction of advance of the cloth piece 1 from a front end in the lower and slightly forward part of the suspending and guiding section 12*c* of the table 12. A third cylinder 34*f* for expanding and contracting with respect to the first holding and releasing member 34*a* is fixed to the fixed support base 15*a*, and a third holding and releasing member 34*g* to approach and separate from the cloth piece holding surface on the forward side of the table 12 in the first holding and releasing member 34*a* is fixed to the rod end of the third cylinder 34*f*.

Figure 10:
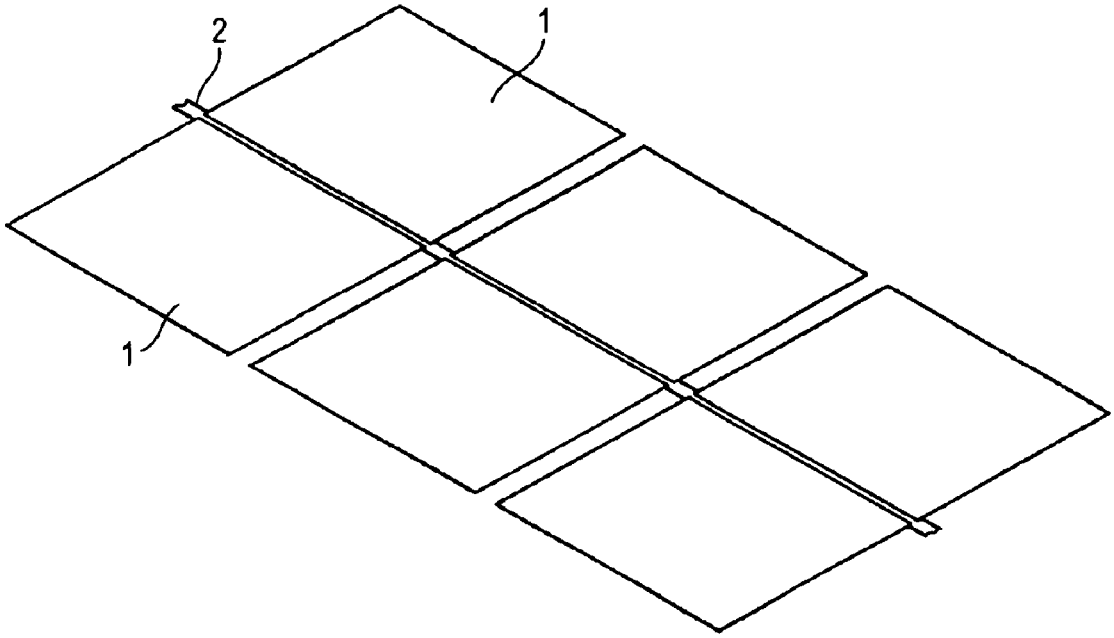
FIG. 10 is a partial perspective view showing the configuration of the cloth piece coupled by the fastener chain.
Figure 11:
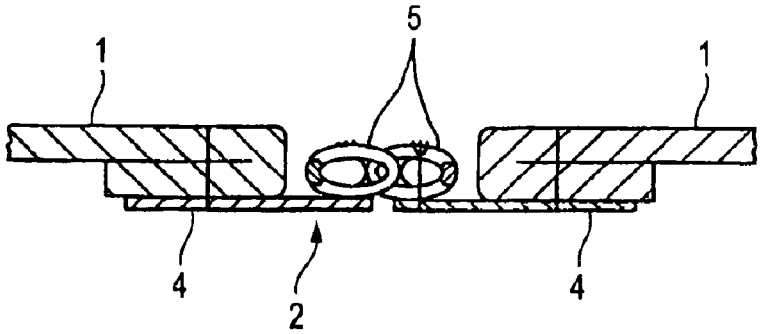
FIG. 11 is a cross-sectional view showing the cloth piece onto which the fastener chain is sewn.

The sewing machine 11 is a conventional double needle sewing machine which is constituted to provide a pair of parallel sewing lines on the cloth piece 1 passing through a portion under a presser foot and can form a chain stitch and a lock stitch. When two left and right cloth pieces 1 to be the sewing objects of the fastener chain 2 are sequentially transferred at a preset interval toward the sewing section 12*a* of the table 12, the fastener chain 2 supplied continuously is sequentially sewn onto the opposed edge portions of the two cloth pieces 1 as shown in FIG. 10, and passes through the transfer section 12*b* over the table 12 and is positively fed downward over the cloth piece delivery section 28 provided along the suspending and guiding section 12*c*. During the sewing, the opposed side edges of the two cloth pieces 1 are folded back like a U shape and left and right fastener tapes 4 are attached through sewing with a fastener element 5 of the fastener chain 2 mated with the edge portions folded back as shown in FIG. 11.

In the embodiment, the fastener chain 2 between the cloth pieces 1 intermittently sewing the continuous fastener chain 2 fed downward in a suspending state along the suspending and guiding section 12*c* is cut away to be the sewn product 3 as described above, and is received by the holding and releasing means 34 of the sewn product receiving section 14 standing by in a lower part, and is then transferred to the supply side of the cloth piece 1 in an open space formed under the table 12 by the sewn product transfer means 33.

Figure 5:
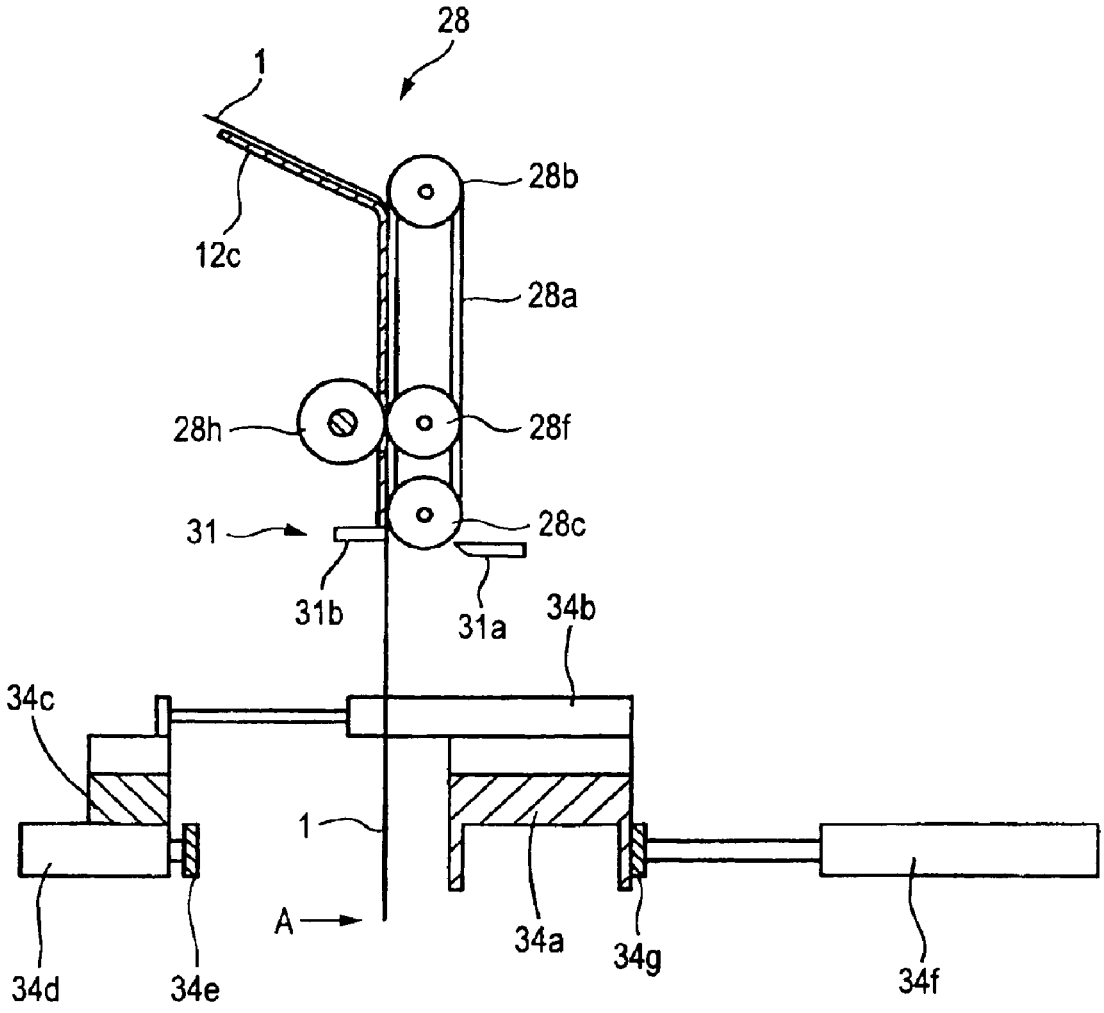
FIG. 5 is an explanatory view showing the operations of the delivery section and the sewn product receiving section which are carried out when the cloth piece is set in a suspending state.

More specifically, as shown in FIG. 5, when the sewn cloth piece 1 is guided from the transfer section 12*b* to the suspending and guiding section 12*c* in the table 12 and is positively transferred downward by the non-end belt 28*a* of the delivery section 28 in the suspending and guiding section 12*c*, a detection signal is sent to the length measuring device 29 through a control section (not shown) and the length measuring device 29 starts to measure a length if the front edge of the cloth piece 1 is detected by the first end detector 30*a*. The length measuring device 29 is always ready to measure a length, and the control section (not shown) stores a distance from the length measuring device 29 to a holding position A of the holding and releasing means 34 in the sewn product receiving section 14 which stands by in a lower part. The lower end of the cloth piece 1 reaches the holding position A of the holding and releasing means 34.

Figure 6:
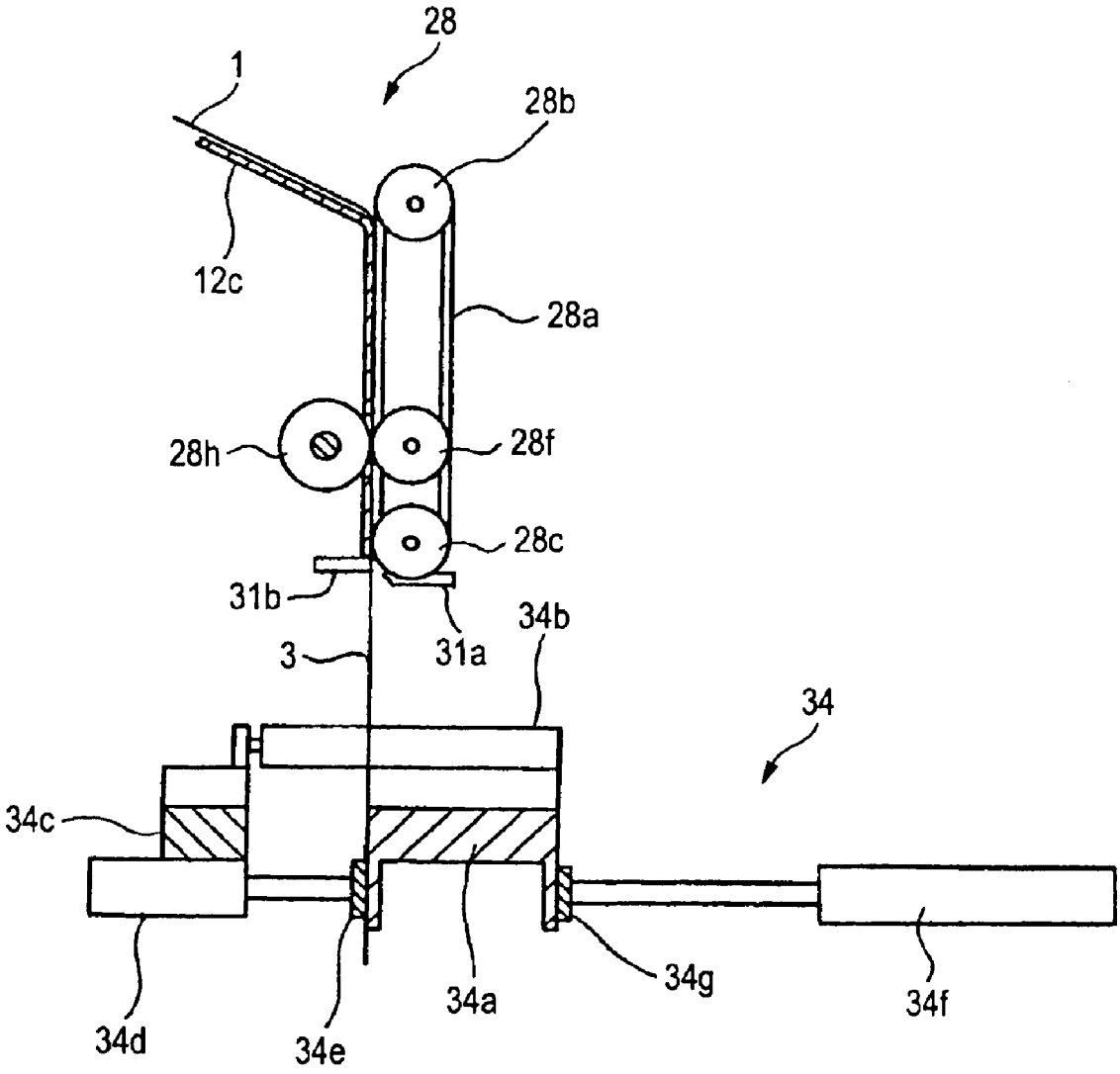
FIG. 6 is an explanatory view showing the operations of the delivery section and the sewn product receiving section, illustrating a state in which the suspending end of the cloth piece is held by first and second holding and releasing members.
Figure 7:
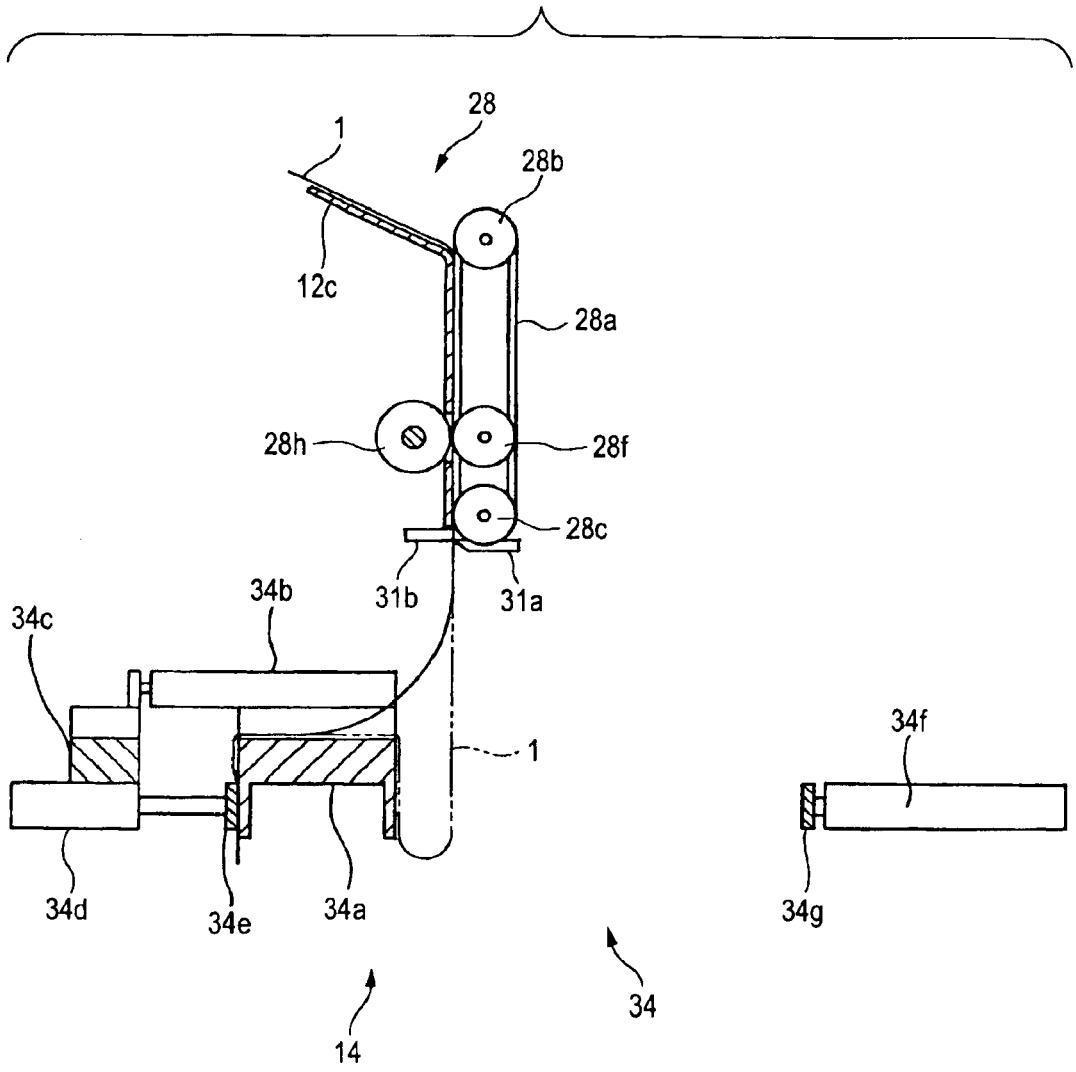
FIG. 7 is an explanatory view showing an operation, illustrating the delivery state of the residual portion of the cloth piece in the suspending state.

When the suspending end of the sewn cloth piece 1 reaches the holding position A, the driving roller 19 of the sewn product delivery means 33 is driven by a driving motor (not shown) to rotate the rotating belt 18, thereby moving the holding surface of the first holding and releasing member 34*a* toward the suspending end of the cloth piece. At the same time, the first cylinder 34*b* of the holding and releasing means 34 is operated to move the second holding and releasing member 34*c* toward the first holding and releasing member 34*a*, and the second cylinder 34*d* is operated to move the holding plate member 34*e* toward the suspending end, thereby interposing and holding the suspending end of the cloth piece 1 between the holding surface of the holding plate member 34*e* and that of the first holding and releasing member 34*a* under the suspending and guiding section 12*c* as shown in FIG. 6. When the interposition and holding is carried out, the rotating belt 18 is rotated to move the first and second holding and releasing members 34*a* and 34*c* toward the supply portion side of the cloth piece 1 up to a position in which the cloth piece 1 having an end held crosses the upper surface of the first holding and releasing member 34*a*, thereby catching the cloth piece 1 on the upper surface of the first holding and releasing member 34*a* as shown in FIG. 7.

In the meantime, the operation of the delivery section 28 continues to feed the residual portion of the cloth piece 1 downward. At this time, the first holding and releasing member 34*a* is placed in a rear position in which it does not interfere with the suspending of the cloth piece 1. Therefore, the residual portion of the cloth piece 1 suspends like a U shape in a forward position across the first holding and releasing member 34*a* as shown in a solid line of FIG. 8. When the residual portion of the cloth piece 1 is further fed and the upper end of the cloth piece 1 having a predetermined length then reaches the cutting blade 31*a* of the cutting section 31, the driving operation of the driving roller 28*h* is stopped and a cylinder (not shown) of the cutting section 31 is operated so that the cutting blade 31*a* is moved toward the cloth piece 1 to cut the fastener chain 2 sewn between the left and right cloth pieces 1.

All operation timings in the cutting are based on a command signal sent from the control section which is not shown. For example, in the embodiment, the front end of the cloth piece 1 obtained after the sewing is detected by the first cloth piece end detector 30*a* shown in FIG. 1 and a detection signal is sent to the control section which is not shown. At this time, the length measuring device 29 simultaneously measures the length of the cloth piece 1 which is delivered and sends a measuring signal to the control section. The control section previously stores a distance between a position in which the first cloth piece end detector 30*a* is provided and the cutting blade 31*a*. When a value obtained by subtracting the distance between the position in which the first cloth piece end detector 30*a* is provided and the length measuring device 29 from a length measured by the length measuring device 29 in the input of the detection signal of the first cloth piece end detector 30*a* reaches the distance between the position in which the first cloth piece end detector 30*a* is provided and the cutting blade 31*a*, the driving operation of the driving roller 28*h* is stopped, and at the same time, the cylinder (not shown) of the cutting section 31 is operated to move the cutting blade 31*a* toward the fixed blade 31*b*.

When the fastener chain 2 is to be cut, the driving operation of the cloth piece delivery section 28 is stopped. In the case in which the subsequent cloth piece 1 is being sewn, the sewing operation is continuously carried out. For this reason, the subsequent cloth piece 1 is exactly fed forward and the supply of the cloth piece 1 becomes excessive so that the cloth piece 1 is accumulated in the transfer section 12*b* provided on the suspending and guiding section 12*c* of the table 12 and floats above the cloth delivery section 28. The stoppage of the sewing machine 11 is detected by the second cloth piece end detector 30*b* for detecting the rear edge of the cloth piece 1 which is provided in front of the sewing apparatus 10. When the sewing operation is continuously carried out in the cutting of the fastener chain 2, the sewing operation is performed until the rear edge of the cloth piece 1 which is being sewn is detected by the second cloth piece end detector 30*b*.

When the rear edge of the subsequent sewn cloth piece 1 is detected by the second cloth piece end detector 30*b*, the sewing operation is stopped. When the cutting operation is completed, the driving operation of the driving roller 28*h* of the cloth piece delivery section 28 is started. At this time, the driving roller 28*h* is temporarily rotated at a high speed to increase the amount of delivery of the cloth piece 1. Consequently, the cloth piece 1 accumulated on the table 12 is pulled downward through the suspending and guiding section 12*c*. Simultaneously with the start of the driving operation of the driving roller 28*h*, the sewing machine 11 is driven to start the sewing operation. On the other hand, the amount of sewing of the cloth piece 1 which is obtained from the stoppage of the driving roller 28*h* of the cloth piece delivery section 28 to the stoppage of the driving operation of the sewing machine 11 is measured by a timer provided in the sewing machine 11, for example. A driving section (not shown) of the driving roller 28*h* is informed of the amount of sewing through the control section (not shown), thereby controlling a time required for the high-speed rotation of the driving roller 28*h*.

The length of the cloth piece to be the sewing object is not always uniform. In many cases, accordingly, the cutting timing cannot be uniform. In the embodiment, it is also possible to detect the front and rear edges of the sewn cloth piece 1 by the second cloth piece end detector 30*b*. The front and rear ends of the cloth piece 1 can be distinguished by a change into a light and darkness during the detection and a reverse change. When the front end of the cloth piece 1 having the fastener chain 2 sewn thereonto is first detected by the second cloth piece end detector 30*b*, a detection signal is sent to the control section (not shown) to start timing and the timing is carried out until the detection signal of the rear end of the cloth piece 1 to be next input is input. The length of the cloth piece 1 which is being sewn is determined by a sewing speed (the delivery speed of the delivery section 28). Therefore, the control section calculates the length of the cloth piece 1 based on the time obtained as described above. Next, the control section further calculates the operation timing of the cutting section 30 upon receipt of signals sent from the first cloth piece end detector 30*a* and the length measuring device 29 and operates the cutting blade 31*a* in a suitable timing, thereby cutting the fastener chain 2 exposed between the front and rear cloth pieces 1.

In the invention, it can be understood that the length of the cloth piece 1 can also be measured by the first cloth piece end detector 30*a* and the length measuring device 29, for example, even if the complicated control procedure is not executed. Thus, the measurement can be carried out for each of the sewn cloth pieces 1 to calculate an accurate length, and the cutting blade 31*a* can be automatically operated corresponding to the length. For example, even if cloth pieces having various lengths are fed into the sewing section 12*a* together, therefore, a countermeasure can automatically be taken to remarkably enhance a sewing efficiency.

Figure 8:
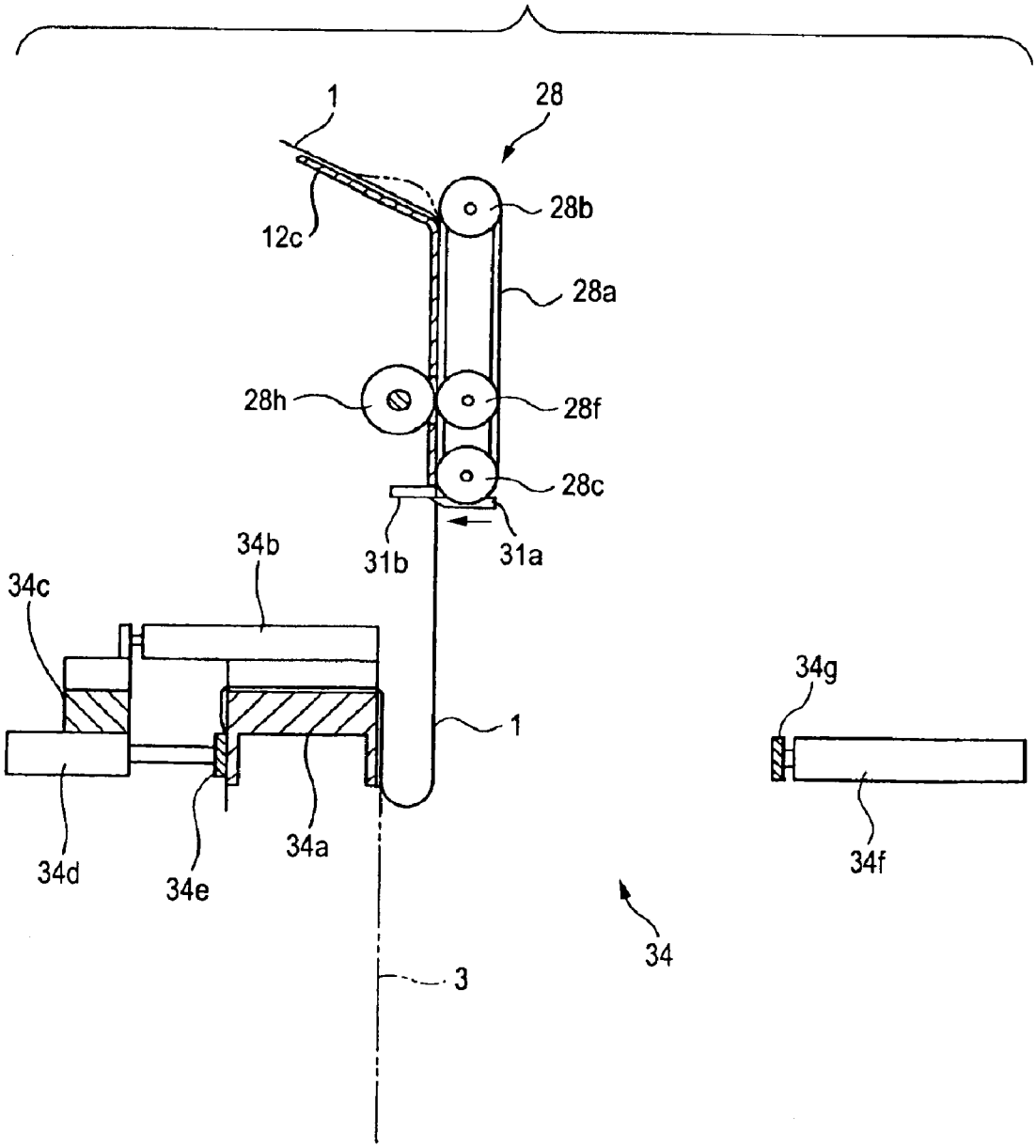
FIG. 8 is an explanatory view showing an operation to be carried out when the fastener chain of the cloth piece set in the suspending state is to be cut.

As described above, when the sewn product 3 to be a final product from which the fastener chain 2 is cut by means of the cutting section 31 has a front end held by the first and second holding and releasing members 34*a* and 34*c* and the other end suspending forward across the upper surface of the first holding and releasing member 34*a* as shown in a virtual line of FIG. 8, the rotating belt 18 is reversely rotated to move the first and second holding and releasing members 34*a* and 34*c* to a forward standby position. At the same time, the third cylinder 34*f* is operated to move the third holding and releasing member 34*g* toward a holding surface on the forward side of the first holding and releasing member 34*a*, thereby interposing and holding the suspending portion of the sewn product 3 between the first holding and releasing member 34*a* and the third holding and releasing member 34*g* as shown in FIG. 9.

Figure 9:
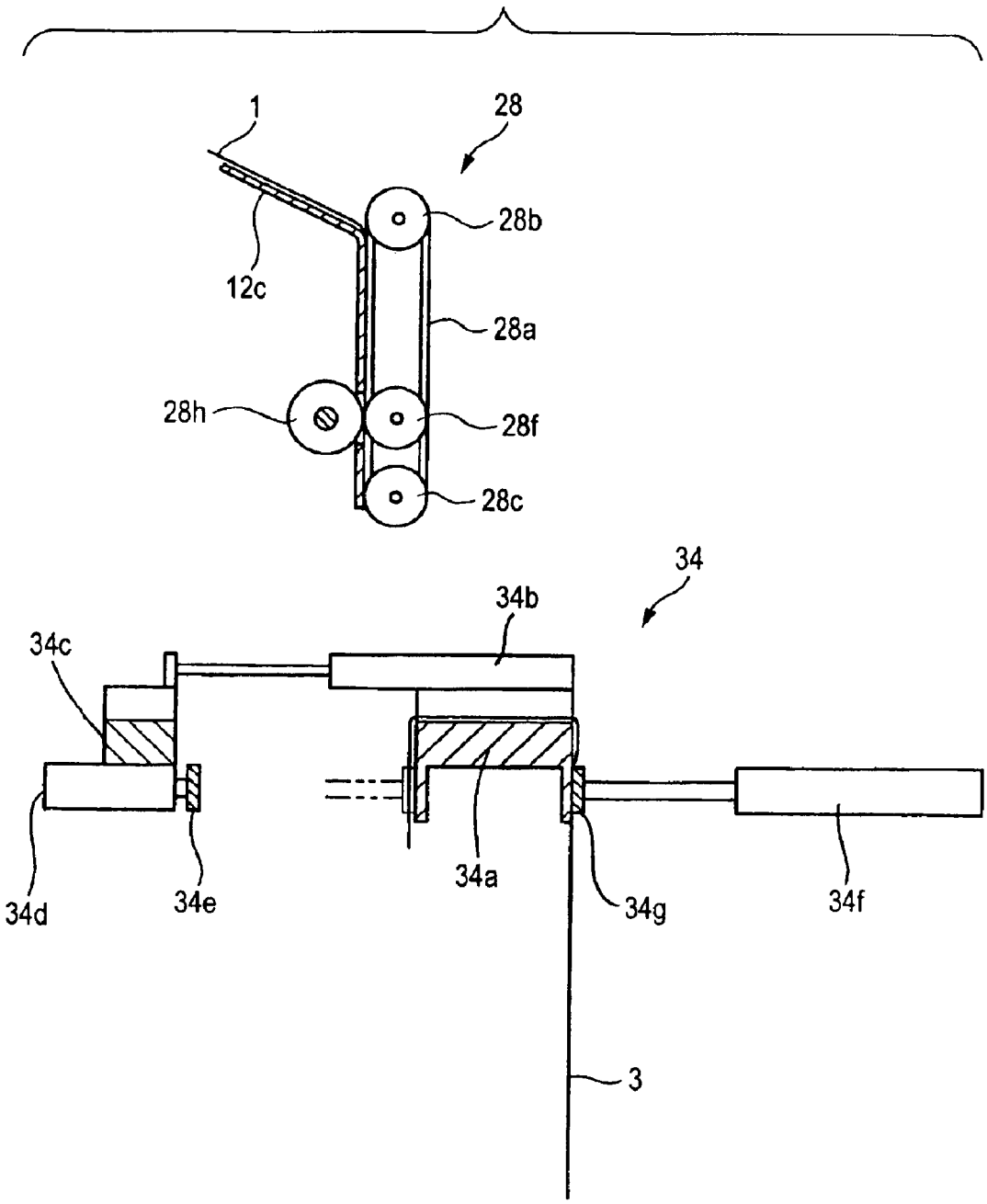
FIG. 9 is an explanatory view showing the operations of the delivery section and the sewn product receiving section, illustrating a state in which the suspending end of the cloth piece is held by first and third holding and releasing members.

At the same time that the holding is completed between the first holding and releasing member 34*a* and the third holding and releasing member 34*g*, the first cylinder 34*b* is operated in an extending direction and the second cylinder 34*d* is operated in a contracting direction, thereby releasing the interposition and holding between the first holding and releasing member 34*a* and the holding plate member 34*e* of the second holding and releasing member 34*c* as shown in FIG. 9. Thus, the sewn product 3 is held between the first holding and releasing member 34*a* and the third holding and releasing member 34*g* in a standby position and can be prevented from dropping.

When the holding is completed, the suspending end of the cloth piece 1 is supplied between the first holding and releasing member 34*a* and the second holding and releasing member 34*c* again and the rotating belt 18 of the sewn product transfer means 33 is operated, and at the same time, the first and second cylinders 34*b* and 34*d* of the holding and releasing member 34 are operated and the first and second holding and releasing members 34*a* and 34*c* are moved toward the suspending end to carry out holding. At this time, the third cylinder 34*f* is operated in an extending direction, and the third holding and releasing member 34*g* and the first holding and releasing member 34*a* maintain a state in which the sewn product 3 is held. Consequently, the sewn product 3 can be prevented from dropping. When holding the cloth piece 1 and the sewn product 3 between the first holding and releasing member 34*a* and the second holding and releasing member 34*c*, the third holding and releasing member 34*g* operates the third cylinder 34*f* in a contracting direction to release the holding of the sewn product 3. The above operations are repeated to cause the first holding and releasing member 34*a* to hold the sewn product 3 one after another.

At this time, the number of the sewn products 3 held together with the first holding and releasing member 34*a* is counted by a counter which is not shown. When the number reaches a preset number, and the fastener chain 2 sewn onto a last cloth piece 1 is cut and the holding operations of the first and second holding and releasing members 34*a* and 34*c* are completed, the rotating belt 18 starts a rotation to move the first holding and releasing member 34*a* toward a discharge section 35 on the supply section side of the cloth piece 1 as shown in a virtual line of FIG. 1. At this time, a predetermined number of sewn products 3 are guided to the upper surface of the guide plate 24 provided in the lower space portion of the rotating belt 18 and are transferred to the discharge section 35. When the first holding and releasing member 34*a* reaches the discharge section 35, the first cylinder 34*b* is operated in the extending direction and the second cylinder 34*d* is operated in the contracting direction to release the sewn product 3.

In the embodiment, thus, the sewn product 3 fed sequentially in a suspending condition is received by the sewn product receiving section 33 provided below the suspending and guiding section 12*c*, and furthermore, the sewn product 3 is held by the holding and releasing members 34*a*, 34*d* and 34*g* and the rotating belt 18 is then rotated to automatically transfer the sewn product 3 toward the discharge section 35 on the cloth piece supply side by utilizing the lower space of the table 12 while holding the sewn product 3 by the first and second holding and releasing members 34*a* and 34*d* and to then release the sewn product 3. Consequently, an extra space can be effectively utilized. In addition, the table 12 is formed almost angularly as seen from a side. Also in the case in which the cloth piece 1 having an equal length to that of the conventional art is to be delivered, therefore, the length of the whole apparatus can be reduced. Thus, a transfer space for the sewn product 3 can be effectively utilized, and furthermore, the length of the whole apparatus can be reduced.

In the apparatus according to the embodiment shown in the drawing, the sewn products 3 received by the tip portion of the table 12 can also be transferred one by one to the discharge section on the cloth piece supply section side and can be discharged.

More specifically, when the preceding cloth piece 1 in the embodiment is transferred downward in the delivery section 28 and the suspending end of the sewn cloth piece 1 reaches the holding position A as shown in FIG. 5, the first cylinder 34*b* of the holding and releasing means 34 is operated to move the second holding and releasing member 34*c* toward the first holding and releasing member 34*a*, and furthermore, the second cylinder 34*d* is operated to move the holding plate member 34*e* toward the suspending end of the cloth piece 1.

As shown in FIG. 6, the suspending end of the cloth piece 1 is interposed and held between the holding surface of the holding plate member 34*e* and that of the first holding and releasing member 34*a*. When the interposition and holding is completed, the driving roller 19 of the sewn product transfer means 33 is driven by a driving motor (not shown) to rotate the rotating belt 18, thereby moving the first and second holding and releasing members 34*a* and 34*c* toward the supply section side of the cloth piece 1 up to a position in which the cloth piece 1 having an end held crosses the upper surface of the first holding and releasing member 34*a* to catch the cloth piece 1 on the upper surface of the first holding and releasing member 34*a* as shown in FIG. 7.

When the movement of the first and second holding and releasing members 34*a* and 34*c* is completed, the press roller 28*f* and the driving roller 28*h* rotate the non-end belt 28*a* with the cloth piece 1 interposed therebetween, thereby feeding the residual portion of the cloth piece 1 downward. At this time, the first holding and releasing member 34*a* is placed in a rear position in which it does not interfere with the suspending of the cloth piece 1. Therefore, the residual portion of the cloth piece 1 suspends like a U shape in a forward position across the first holding and releasing member 34*a* as shown in a solid line of FIG. 8.

When the residual portion of the cloth piece 1 is further fed and the upper end of the cloth piece 1 having a predetermined length reaches the cutting blade 31*a* of the cutting section 31, the cylinder (not shown) of the cutting section 31 is operated to move the cutting blade 31*a* toward the cloth piece 1, thereby cutting the fastener chain 2 sewn between the left and right cloth pieces 1.

When the fastener chain 2 is thus cut, the rotating belt 18 starts an operation to transfer one sewn product 3 held by the first and second holding and releasing members 34*a* and 34*c* to the discharge section 35 on the cloth piece supply section side. When the sewn product 3 reaches the discharge section 35, the first cylinder 34*b* is operated in the extending direction and the second cylinder 34*d* is operated in the contracting direction to release the sewn product 3. When an operator completely takes the sewn product 3 out of the discharge section 35, the rotating belt 18 is operated to transfer the first holding and releasing member 34*a* to a standby position placed below the tip of the table 12 together with the second holding and releasing member 34*c* and to cause them to stand by in order to hold the suspending end of the succeeding sewn product 3. After the suspending end of the succeeding sewn product 3 is held by the first and second holding and releasing members 34*a* and 34*c*, the above operations are carried out to discharge the sewn product 3 to the discharge section 35 on the cloth piece supply section side, and to return to original positions and to stand by. By repeating this operation, the sewn products 3 are fed and discharged one by one to the discharge section 35.

While the description has been given by taking the typical embodiment of the invention, it can be understood that the invention can be variously changed within the scope described in the claims. Moreover, all the operation timings of the operating members can be automatically carried out in accordance with a sequence which is preset in a control section (not shown).

What is claimed is:

1. An apparatus for sewing a slide fastener chain onto a cloth piece in which a slide fastener chain supplied continuously is successively sewn onto a pair of cloth pieces having an optional size, comprising:

a table on which a sewing machine is provided and which guides the cloth pieces during sewing;

a cutting section having chain cutting means for cutting the fastener chain between the cloth pieces having the fastener chain sewn by the sewing machine, moved continuously over the table and suspending from a front end of the table; and a sewn product receiving section having sewn product transfer means for receiving, in a lower part, a sewn product cut away by the cutting means from the succeeding cloth piece having the fastener chain sewn thereonto and transferring the sewn product to a rear end of the table through a lower space portion of the table.

2. The sewing apparatus according to claim 1, wherein the table includes:

a sewing section having an upward inclined surface;

a cloth piece transfer section having a downward inclined surface which is provided continuously with the sewing section; and a suspending and guiding section for suspending and guiding the cloth piece from a front edge of the cloth piece transfer section.

3. The sewing apparatus according to claim 2, further comprising:

a cloth piece delivery section for energizing toward the suspending and guiding section and controllably rotating synchronously with a sewing speed of the sewing section.

4. The sewing apparatus according to claim 1, further comprising:

front edge detecting means for detecting front edge of the cloth piece; and length measuring means for measuring the cloth piece, wherein the front edge detecting means and the length measuring means are provided in a transfer path of the cloth piece.

5. The sewing apparatus according to claim 4, wherein the cutting means operates after the length measuring means starts a measurement based on a detection signal of the front edge which is sent from the front edge detecting means and a predetermined length is measured by the length measuring means.

6. The sewing apparatus according to claim 1, wherein the sewing product receiving section, which operates every time the sewn product is received, moves the sewn product transfer means to a discharge section of the rear end of the table to discharge the sewn product and then returns to a receiving portion.

7. The sewing apparatus according to claim 1, wherein the sewn product receiving section has holding and releasing means for holding and releasing the cloth piece to reciprocate between a portion placed below the front end of the table and a portion placed below the rear end of the table.

8. The sewing apparatus according to claim 7, wherein the sewn product receiving section includes:

a rotating belt provided under the table in a longitudinal direction;

a first holding and releasing member fixed to a part of the belt and extended in a transverse direction of the table;

a first cylinder fixed to the first holding and releasing member; and a second holding and releasing member which is supported on the first cylinder and is provided adjacently and opposite to a cloth piece holding surface of the first holding and releasing member.

9. The sewing apparatus according to claim 8, wherein the sewn product receiving section further includes:

a fixed support base provided under the table and extended in a transverse direction of the table from an adjacent portion to a forward part;

a third cylinder supported on the fixed support base;

a third holding and releasing member supported on the third cylinder and provided adjacently and opposite to a cloth piece holding surface of the first holding and releasing member on a forward side of the table; and a second holding and releasing member which is supported on the first cylinder and is provided adjacently and opposite to a cloth piece holding surface of the first holding and releasing member on a rear side of the table.

10. The sewing apparatus according to claim 8, further comprising:

a second cylinder fixed to the second holding and releasing member; and a second cloth end holding surface supported on the second cylinder and provided adjacently and opposite to the cloth piece holding surface of the first holding and releasing member.

11. The sewing apparatus according to claim 1, wherein the cutting section has a counter for counting the number of operations of the cutting means, and the sewn product receiving section, which operates when the counter counts a predetermined number, moves the sewn product transfer means to a discharge section of the rear end in a lower part of the table to discharge the sewn product and then returns to a receiving portion for the sewn product.

* * * * *